US006308990B1

(12) United States Patent
Brick

(10) Patent No.: US 6,308,990 B1
(45) Date of Patent: Oct. 30, 2001

(54) ARTICLE PACKAGING ASSEMBLY

(76) Inventor: Ralph B. Brick, 2303 Tuckaho Rd., Louisville, KY (US) 40207

( * ) Notice: Subject to any disclaimer, the term of this patent is extended or adjusted under 35 U.S.C. 154(b) by 302 days.

(21) Appl. No.: 08/901,171

(22) Filed: Jul. 28, 1997

(51) Int. Cl.[7] ..... B42D 15/00

(52) U.S. Cl. ..... 283/79; 40/312; 206/459.5; 229/87.01; 229/87.09; 283/81; 283/100; 283/901

(58) Field of Search ..... 283/94, 98, 99, 283/100, 79, 80, 81, 901; 40/312, 637, 438, 491; 446/369; 206/459.5; 383/205, 206; 229/87.05, 87.01, 87.09

(56) References Cited

U.S. PATENT DOCUMENTS

| | | | | |
|---|---|---|---|---|
| 1,280,347 | * | 10/1918 | Williams | 40/312 |
| 2,194,220 | * | 3/1940 | Elder | 229/87.09 |
| 2,328,688 | * | 9/1943 | Sheerin | 229/87.09 |
| 2,408,317 | * | 9/1946 | Jones | 229/87.09 |
| 2,647,334 | * | 8/1953 | Wilsher et al. | 229/87.09 |
| 3,251,152 | * | 5/1966 | Takefman | 40/312 |
| 3,826,499 | * | 7/1974 | Lenkoff | 283/95 |
| 4,217,713 | * | 8/1980 | Greenberger | 40/488 |
| 4,273,352 | | 6/1981 | Carrier et al. | 283/6 |
| 4,505,497 | * | 3/1985 | Katzman | 283/81 |
| 4,587,156 | | 5/1986 | Wu | 428/207 |
| 4,600,141 | | 7/1986 | Bradley et al. | 229/92.7 |
| 4,825,763 | | 5/1989 | Truskolaski et al. | 101/488 |
| 4,964,513 | * | 10/1990 | Ingram et al. | 283/81 |
| 5,004,271 | * | 4/1991 | Piatt | 40/490 |
| 5,235,768 | * | 8/1993 | Eder | 40/488 |
| 5,287,641 | * | 2/1994 | Showers | 40/488 |
| 5,364,132 | * | 11/1994 | Haas et al. | 283/67 |
| 5,399,021 | | 3/1995 | Litt | 383/5 |
| 5,413,384 | * | 5/1995 | Principe et al. | 283/81 |
| 5,467,917 | | 11/1995 | Potter | 229/301 |
| 5,645,300 | * | 7/1997 | Hill | 283/81 |
| 5,838,466 | * | 11/1998 | Mallik | 283/94 |

OTHER PUBLICATIONS

Hershey's kisses chocolates. pp. 1–2. http://www.hershey-s.com/totally/product/kisses, Jan. 12, 1999.*

* cited by examiner

*Primary Examiner*—Allan N. Shoap
*Assistant Examiner*—Monica Carter
(74) *Attorney, Agent, or Firm*—Polster, Lieder, Woodruff & Lucchesi

(57) ABSTRACT

A packaging assembly for at least one article including wrapping material for the article and an elongated tape to assist in removing the wrapping material from the article, the elongated tape including a visible gripping portion positioned externally of the wrapped article and a hidden portion positioned within the wrapped article, each portion of the tape having messages associated therewith which are intellectually compatible.

13 Claims, 1 Drawing Sheet

ARTICLE PACKAGING ASSEMBLY

BACKGROUND OF THE INVENTION

The present invention relates to a package assembly for an article and more particularly to a package assembly which includes wrapping material to cover at least a portion of an article to be packaged and an elongated removal tape, a portion of which is included internally between the article and the wrapping material and a portion of which is external of a wrapped article to enhance removal of the wrapping material from the article.

The aforedescribed general arrangement is well known to the average consumer in the purchase and subsequent use of packaged food materials—particularly candies and can be found employed with stationery envelopes which utilize an adhesive tape with an external tab for opening the envelopes. The present invention recognizes that these features are broadly well known in both the food and stationary arts—such as with individual chocolate candy wrappers and with contest wrappers. The present invention further recognizes that advertising messages are sometimes employed with one or more of the packaging units—for example on a tape, wrapper or envelope. In this regard, attention is directed to the printed tapes as disclosed in U.S. Pat. No. 4,587,156, issued to M. S. Wu on May 6, 1986 and U.S. Pat. No. 4,825,763, issued to B. S. Truskolaski et al on May 2, 1989; to the envelope structure as disclosed in U.S. Pat. No. 4,600,141, issued to W. P. Bradley et al on Jul. 15, 1986 and U.S. Pat. No. 5,467,917, issued to R. Potter on Nov. 21, 1995; and finally to the information bearing articles of U.S. Pat. No. 4,273,362 issued to L. A. Carrier et al on Jun. 16, 1981 and U.S. Pat. No. 5,399,021, issued to L. Litt on Mar. 21, 1955. Although each of these patents teaches one or more of the elements of the present invention, none teaches the unique and novel structure as set forth herein which is comparatively straight forward and economical to manufacture and assemble and which provides for structure which allows for a ready disassembly of a wrapped package to permit access to a previously wrapped article and which simultaneously allows for a ready completion of an intellectual message, a portion of which is part of and external of the wrapped package and a remaining portion of which is hidden within such wrapped package.

Various other features of the present invention will become obvious to one skilled in the art upon reading the disclosure set forth herein.

BRIEF SUMMARY OF THE INVENTION

More particularly the present invention provides a packaging assembly for at least one article comprising: a wrapping material sized to wrap a preselected portion of the outer surface of at least one article; an elongated tape including a visible gripping portion adapted to be positioned externally of the wrapped article and a hidden portion adapted to be positioned within the inner surface of the wrapping material whereby the wrapping material may be unwrapped from the article by applying an appropriate force on the visible gripping portion of the tape, the visible gripping portion of the elongated tape having a first message associated therewith and the hidden portion of the elongated tape having a second message associated therewith intellectually compatible with the first message which becomes available for viewing upon unwrapping the wrapping material from the article. In addition the present invention provides for a number of variations to the novel and inventive package assembly which include marking the intellectually compatible messages in compatible written language, in compatible symbols and in invisible form to be subsequently developed.

It is to be understood that various changes can be made by one skilled in the art in one or more of the several parts of the present invention without departing from the scope or spirit of the invention.

BRIEF DESCRIPTION OF THE DRAWINGS

Referring to the drawings which disclose one advantageous embodiment of the present invention and modifications thereof.

DETAILED DESCRIPTION OF THE DRAWINGS

Figure 1:
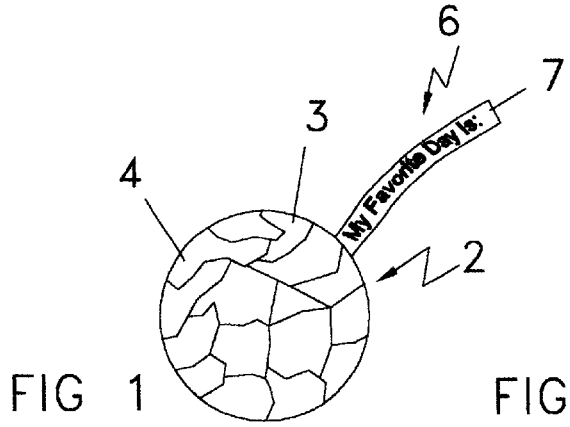
FIG. 1 is a plan view of a wrapped article of manufacture—such as a confectionery—incorporating a hidden portion of an elongated tape nesting within the inner surface of the wrapper and at least one wrapped article and a visible portion of the elongated tape, the inner portion and outer portion of the tape each bearing compatible written messages, only the outer visible message showing.
Figure 2:
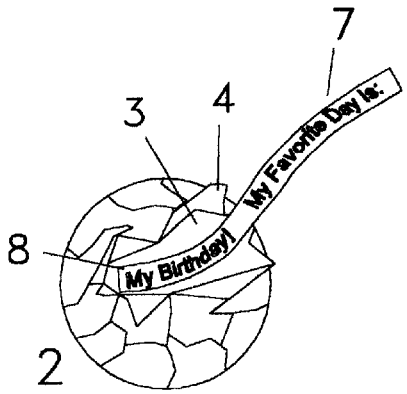
FIG. 2 is a plan view of a partially unwrapped article of FIG. 1, disclosing both compatible messages on both portions of the tape.

Referring to FIGS. 1 and 2 of the drawings a package assembly 2 is disclosed incorporating the novel features of the present invention. A wrapped article 3 is disclosed. Article 3 can be any one of several articles know in commerce—such as candies, cookies, marbles, or even a letter envelopes (as described hereinafter.) Wrapped article 3, as here shown, can be a candy ball piece (FIG. 2) covered or protected by wrapper sheet 4, which can be of a suitably selected flexible wrapping material, such as colored paper or clear or opaque plastic. An elongated, preferably thin strip of tape 6, also of a suitably selected material, can be provided to cooperate with wrapper sheet 4.

As shown in FIG. 1 of the drawings, tape 6 includes a visible gripping portion 7 which is adapted to be positioned externally of wrapper sheet 4 and also includes a hidden portion 8 (FIG. 2) which can be adapted to be nested between the outer surface or face of article 3 and the inner wrapping surface or face of wrapping sheet 4. With this wrapping arrangement for wrapped, article 3, sheet 4 may be readily removed from wrapped article 3 by applying a simple hand tearing force on the visible gripping portion 7 of tape 6 so as to then expose hidden portion 8 of tape 6. In accordance with a principal feature of the present invention, each respective visible portion 7 and hidden portion 8 of tape 6 can be provided with a message printed thereon which printed messages advantageously are intellectually compatible. As shown in FIGS. 1 and 2 of the drawings, the visible gripping portion 7 of tape 6 is provided with the message: "My Favorite Day Is?" and the hidden portion 8 of tape 6 incorporates the printed message, "My Birthday." It, of course, is to be understood that various messages can be utilized for example—visible, "She loves me", and hidden "Yes she does." It also is to be understood that more than one article can be wrapped by a wrapper sheet and that the hidden portion of a tape with its compatible message can be incorporated within an article or between articles.

Figure 3:
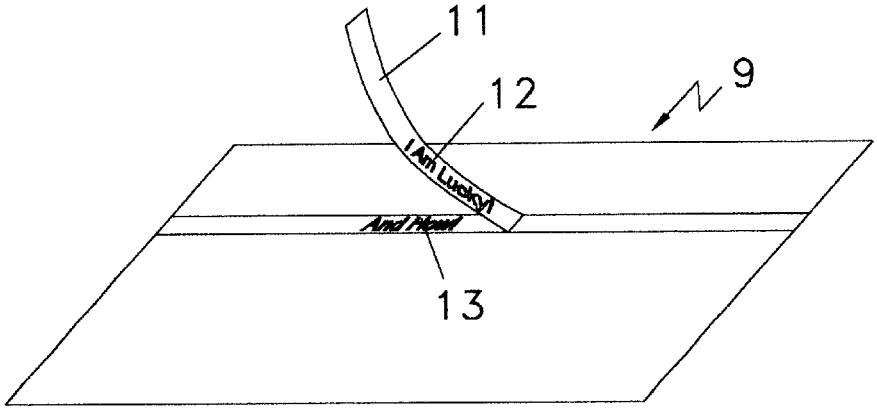
FIG. 3 is a partially broken away view of an envelope disclosing the inventive concept in envelope form.

Referring to FIG. 3 of the drawings, the inventive concept is shown as incorporated in an envelop 9 including pull tape 11 with a visible pull or tear away portion 12 and a hidden portion 13 bearing, respectively, the compatible messages, "I Am Lucky!" and the responsive "And How."

Figure 4:
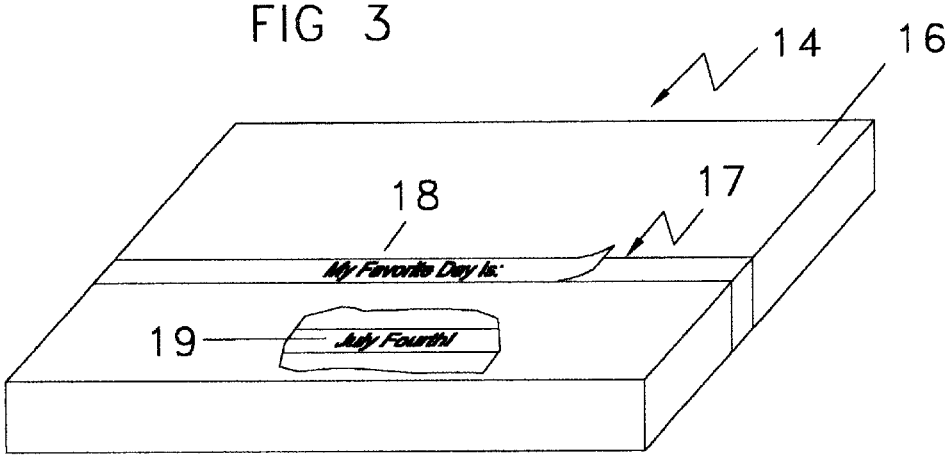
FIG. 4 is a partially broken away view of a package disclosing the inventive concept in gift package form.

Referring to FIG. 4 of the drawings, the inventive concept is shown as part of a wrapped box or gift package 14, including a wrapper sheet 16, a tape 17 having a visible pull or tear away portion 18 an a hidden portion 19, bearing, respectively, the compatible messages, "My Favorite Day Is" and the responsive "July Fourth".

Figure 5:
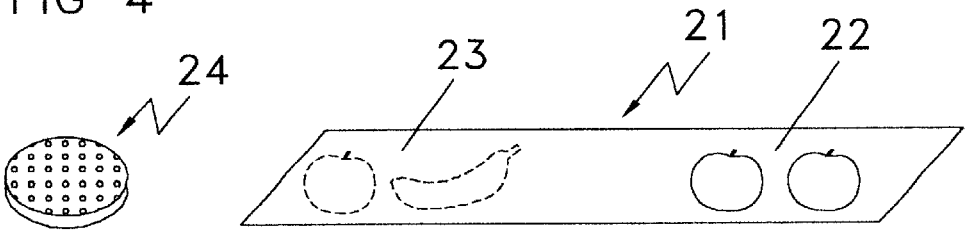
FIG. 5 is an exploded view of a further feature of the inventive concept in the form of fruit symbols incorporated in a game of chance with one of the message portions printed in invisible ink to be developed by a marking instrument.

Referring to FIG. 5 of the drawings, still another feature of the present invention is disclosed, showing a tape 21 which might be employed as part of a wrapped game with a visible portion 22 bearing two "apple" visible fruit symbols and a portion 23 to be hidden, if so desired, bearing two invisibly marked symbols comprising apple and banana invisible fruit symbols. The invisibly marked fruit symbols on portion 23 can be developed with an appropriate marking instrument 24. It is to be understood that the tape 21 and marking instrument 24 can be employed in packaging arrangements such as those disclosed in FIGS. 1–4 or on tapes similar to tapes 6,12,17 and 21 all of which incorporate, the inventive concept. Such tapes can be marketed separately with a variety of messages, advantageously in rolls, for packaging purposes or for use in games, with those tapes similar to tape 21 including an accompanying marking instrument, like instrument 24, to develop the invisibly marked messages.

The invention claimed is:

1. A packaging assembly for at least one article having an outer surface comprising: a wrapping material having an inner and outer surface sized to completely wrap said outer surface of said article; an elongated single, unitary tape having spaced visible and hideable portions of a single message printed thereon including a visible gripping portion adapted to be positioned externally of said wrapped article and a wrapper hidden portion adapted to be nested within the inner surface of said wrapping material whereby said wrapping material is removably unwrapped from said article by applying an appropriate force on said visible gripping portion of said tape, said visible gripping portion of said elongated tape having printed thereon a first response solicitive portion of said message associated therewith and said wrapper hidden portion of said elongated tape having printed thereon a second differing and responsive completing portion of said message associated therewith intellectually compatible with and functionally pertaining to and completing said message which becomes available for viewing upon unwrapping said wrapping material from said article, allowing the complete removal of said tape with the entirety of said completed message thereon for ready viewing and for removal of said wrapping material.

2. The packaging assembly of claim 1, said wrapping material comprising a flexible sheet of opaque material substantially covering the entire surface of said article.

3. The packaging assembly of claim 1, said hidden portion of said tape nesting between the inner surface of said wrapping material and the outer surface of said article.

4. The packaging assembly of claim 1, said wrapping material being in envelope form and said elongated tape being structurally cooperative with said envelope to open the same when a force is placed on the visible gripping portion thereof.

5. The packaging assembly of claim 1, said first and second message portions being geometric symbols printed on the visible and hidden portions of said tape.

6. The packaging assembly of claim 1, said first and second message portions being printed on the visible and hidden portions of said tape in different languages which are intellectually compatible.

7. The packaging assembly of claim 1, said first and second message portions being respectively printed on the visible and hidden portions of said tape.

8. The packaging assembly of claim 7, said first message portion being in printed interrogatory form and said second message portion being responsive thereto.

9. The packaging assembly of claim 7, said first message portion being a portion of a game of chance and said second message portion serving to complete said game of chance.

10. The packaging assembly of claim 7, at least one of said first and second message portions being printed in invisible ink; and, a marking instrument to visibly develop said invisible print.

11. A packaging assembly for an article comprising: a disposable sheet of opaque wrapping paper having an inner and outer surface, said wrapping paper including inner and outer surfaces and being sized to cover the outer surface of an edible sweet; an elongated single, unitary thin strip of paper tape having spaced visible and hideable portions of a single message printed thereon, said paper tape including a visible gripping portion adapted to be positioned externally of said outer surface of said edible sweet when wrapped by said wrapping paper and a hidden portion adapted to be nested between said outer surface of said edible sweet when wrapped by said wrapping paper and the inner wrapping surface of said sheet of wrapping paper when said edible sweet is wrapped whereby said sheet of wrapping paper is removable from said outer surface of said edible sweet when wrapped therearound by applying an appropriate force on said visible gripping portion of said elongated thin, single, unitary strip of paper tape, said visible gripping portion of said paper tape having a first response solicitive portion of said single message in the form of a written solicitive interrogatory portion of said single message printed thereon and said wrapper hidden portion having a second portion of said single message printed thereon, compatible with and functionally pertaining to and completing said single message printed thereon which complete single message becomes available for viewing upon unwrapping said wrapped edible sweet when wrapped, allowing complete removal of said complete tape and said wrapping material.

12. An elongated single, unitary tape for packaging and for game usage including first and second spaced portions of a complete printed expression, said first and second portions being adjacent opposed extremities of said tape, each portion having one of two differing intellectual and functionally pertaining compatible message portions printed thereon, one of which message portions is intellectually response solicitive and the other portion of which is intellectually responsive thereto and arrangeable to be wrapper hidden, the intellectually complete message becoming available for viewing upon complete removal of said tape and wrapper.

13. The elongated tape of claim 11, at least one of said message portions being printed with invisible print on said elongated tape; and, a marking instrument to visibly develop said invisible print.

* * * * *